US005839148A

United States Patent [19]

Volpenhein

[11] Patent Number: 5,839,148

[45] Date of Patent: Nov. 24, 1998

[54] TOOTHBRUSH WITH BOTH STATIONARY AND MOVING TUFTS

[75] Inventor: Daniel W. Volpenhein, Mason, Ohio

[73] Assignee: The Procter & Gamble Company, Cincinnati, Ohio

[21] Appl. No.: 839,829

[22] Filed: Apr. 17, 1997

[51] Int. Cl.[6] ..... A46B 7/06; A46B 9/04

[52] U.S. Cl. ..... 15/167.1; 15/172; 15/201

[58] Field of Search ..... 15/167.1, 172, 15/201

[56] References Cited

U.S. PATENT DOCUMENTS

| | | | |
|---|---|---|---|
| D. 246,080 | 10/1977 | Rallis . | |
| D. 282,318 | 1/1986 | Herzfeld . | |
| 1,706,555 | 3/1929 | Weis . | |
| 1,927,365 | 9/1933 | Frolio . | |
| 1,968,303 | 7/1934 | McMath . | |
| 2,122,619 | 7/1938 | McMath | 15/172 |
| 2,172,624 | 9/1939 | Romani | 15/167.1 |
| 2,254,365 | 9/1941 | Griffith et al. . | |
| 2,266,195 | 12/1941 | Hallock | 15/167.1 |
| 3,065,479 | 11/1962 | McGee | 15/201 |
| 3,152,349 | 10/1964 | Brennesholtz . | |
| 4,333,199 | 6/1982 | Del Rosario . | |
| 4,488,328 | 12/1984 | Hyman . | |
| 4,654,922 | 4/1987 | Chen | 15/201 |
| 4,691,405 | 9/1987 | Reed . | |
| 4,864,676 | 9/1989 | Schaiper | 15/201 |
| 5,109,563 | 5/1992 | Lemon | 15/167.1 |
| 5,269,038 | 12/1993 | Bradley . | |
| 5,398,366 | 3/1995 | Bradley . | |
| 5,528,786 | 6/1996 | Porat | 15/201 |

FOREIGN PATENT DOCUMENTS

| | | | |
|---|---|---|---|
| 441712 | 1/1936 | Austria . | |
| 2040222 | 9/1992 | Canada | 15/167.1 |
| 0 066 259 | 12/1982 | European Pat. Off. . | |
| 459 442 | 11/1913 | France . | |
| 2612751 | 9/1988 | France . | |
| 2616306 | 12/1988 | France . | |
| 2621466 | 4/1989 | France . | |
| 393882 | 4/1924 | Germany | 15/201 |
| 94 00 231.2 | 5/1994 | Germany . | |
| 94 08 215.4 | 9/1994 | Germany . | |
| 5076416 | 3/1993 | Japan | 15/201 |
| 1008530 | 10/1965 | United Kingdom . | |

*Primary Examiner*—Randall E. Chin
*Attorney, Agent, or Firm*—William Scott Andes

[57] ABSTRACT

Disclosed is a toothbrush having an elongated handle having a head at one end and tufts of bristles affixed to the head. The head has a stationary section which contains fixed, stationary tufts of bristles, and a movable section with tufts of bristles affixed thereto. The movable section of the head is movably attached to the stationary section. The movable section may be pivotally or hingedly attached to the stationary section. The present toothbrush provides for the control and cleaning ability of fixed tufts, while also providing for the cleaning efficiency and effectiveness of movable tufts which follow the contour of the teeth.

5 Claims, 1 Drawing Sheet

TOOTHBRUSH WITH BOTH STATIONARY AND MOVING TUFTS

FIELD OF THE INVENTION

The present invention relates to toothbrushes, and has further relation to toothbrushes with dual-type bristle tufts. In particular, the present device has relation to toothbrushes having both fixed and movable tufts.

BACKGROUND OF THE INVENTION

The prior art is replete with toothbrushes. It has been know for some time that toothbrushes with heads that are movable in relation to the toothbrush handle may be beneficial in that such movable tufts may follow the contour of the teeth more closely; however, such movable heads result in a loss of control and cleaning effectiveness, especially in the case of hard to reach back teeth. Toothbrushes with stationary heads and fixed tufts are also known, but these do not provide the effectiveness of movable tufts that closely follow the contour of the teeth.

There has therefore been a desire to have a toothbrush with both fixed and movable tufts on the same head, to provide for the control and cleaning ability of fixed tufts, while also providing for the cleaning efficiency and effectiveness of movable tufts. There has also been a desire to eliminate the pinching that occurs with movable toothbrush heads.

SUMMARY OF THE INVENTION

Disclosed is a toothbrush having an elongated handle with a head at one end and tufts of bristles affixed to the head. The head has a stationary section and a movable section movably attached to the stationary section. The tufts of bristles are divided into a plurality of fixed tufts fixably attached to the stationary section, and a plurality of moving tufts fixably attached to the movable section. The movable section may be pivotally or hingedly attached to the stationary section. The moveable section may be attached to the stationary section through at least one living hinge. The moveable section may be surrounded by the stationary section, and specifically may be centered with respect to the stationary section.

The present toothbrush head has a neck end attached to the handle, and an opposing tip end, and the moveable section may be pivotally attached to the stationary section in the proximity of the tip end, or in the proximity of the neck end. The moveable section may be rectangular, oval, triangular, or any other shape. The present toothbrush moveable portion may contain from about 25 to about 40 tufts. The stationary portion may contain from about 10 to about 30 tufts. The ratio of stationary portion tufts to moveable portion tufts may be about 3:1. The moveable portion tufts may be of a different color than the stationary portion tufts. The stationary portion tufts may be positioned non-perpendicularly with respect to an attachment surface of the stationary portion.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
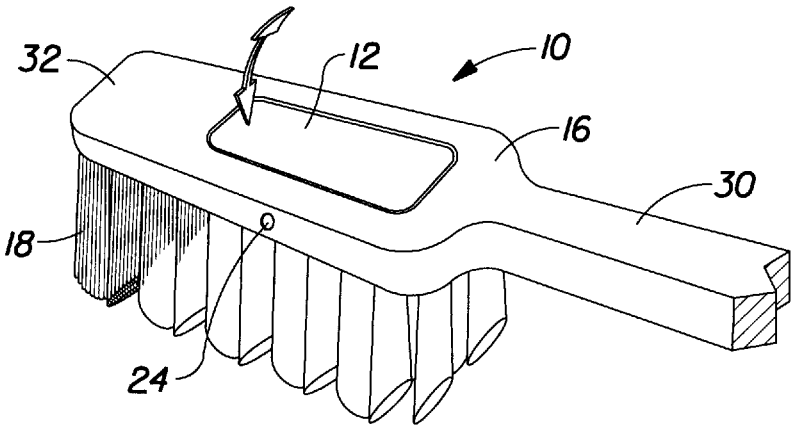
FIG. 1 is a toothbrush head of the present invention showing the direction of rotational movement of the rocking tuft section.
Figure 2:
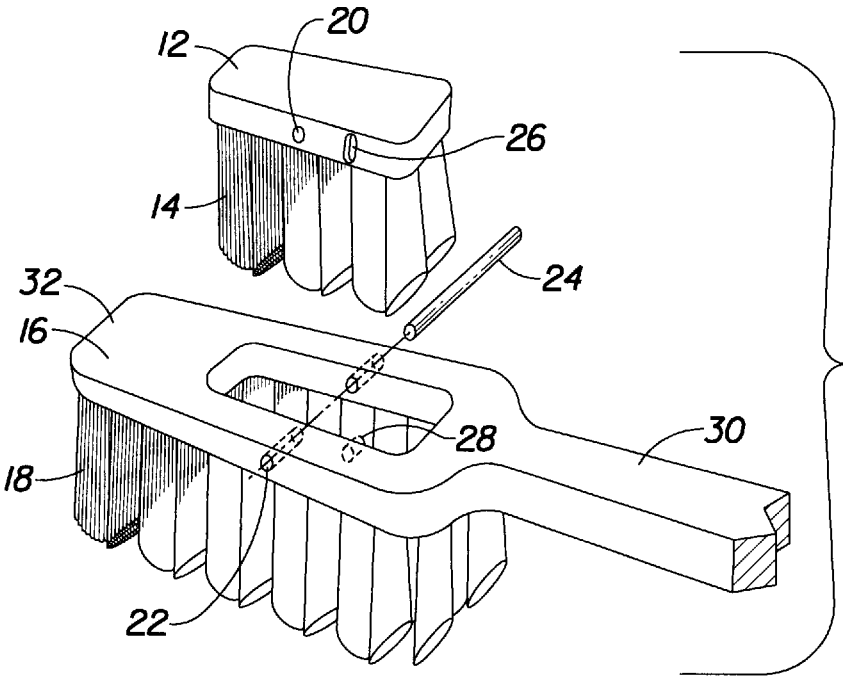
FIG. 2 is the toothbrush head of FIG. 1, showing the components in disassembled form.

Referring now to the drawings in detail wherein like numerals indicate the same element throughout the views there is shown in FIGS. 1 and 2 an embodiment of an exemplary toothbrush head 10 of the present invention. Rocking portion or section 12 is shown as an entirely separate piece of toothbrush head 10, manufactured to fit into an opening within head 10. Fixed into rocking portion 12 are moving tufts of bristles 14; fixed into stationary portion or section 16 are stationary tufts of bristles 18. In this embodiment, rocking portion 12 has a pivot hole 20 positioned laterally through its width. Pivot hole 20 lines up with pin holes 22 positioned laterally through the width of stationary portion 16. When rocking portion 12 is put in place within stationary portion 16, pin 24 may be inserted into place through pin holes 22 and pivot hole 20 to pivotally secure rocking portion 12 to stationary portion 16.

To avoid over-rotation of rocking portion 12, rocking portion 12 is provided with limiting groove 26, and stationary portion 16 is provided with fixed stop 28. Fixed stop 28 is attached to stationary portion 16 to as to line up within groove 26. When rocking portion 12 is in place within stationary portion 16, stop will limit the travel of rocking portion 12 by contacting the inside ends of groove 26 at a predetermined rotational distance about pin 24. This will prevent over-rotation, jamming of rocking portion 12, pinching of the lips, cheeks, and gums, etc.

This device allows for a toothbrush with both fixed and movable tufts on the same head, to provide for the control and cleaning ability of fixed tufts, while also providing for the cleaning efficiency and effectiveness of movable tufts which follow the contour of the teeth. The number and shape of the tufts of bristles contained in rocking portion 12 may be the same as or different from the number and shape of bristles contained in stationary portion 16. The size and shape of rocking portion 12 may be varied with respect to the size and shape of stationary section 16; e.g., rocking portion 12 may be triangular, square, rectangular, circular, oval, or any other shape. Rocking section 12 may be located proximate to handle neck 30, proximate to tip end 32, closer to one side of stationary portion 16 than the other, or in many other positions on head 10. Also, rocking portion 12 may be movable attached to stationary portion 16 by traditional hinges, pins, living hinges, or the like.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A toothbrush comprising:

(a) an elongated handle having a head at one end and bristles affixed to the head; and (b) the head having a stationary portion and a moveable portion, wherein the moveable portion is surrounded by the stationary portion and is connected to the stationary portion by a pin extending through a pin hole which extends laterally through the width of the moveable portion and through a pair of aligned pin holes positioned laterally through the width of the stationary portion, such that the moveable portion is pivotally secured within the stationary portion by said pin wherein the bristles are bundled together in tufts, the tufts being affixed to the head, the stationary portion including stationary portion tufts and the moveable portion including moveable portion tufts.

2. The toothbrush of claim 1 wherein the moveable portion contains from about 25 to about 40 tufts.

3. The toothbrush of claim 1 wherein the stationary portion contains from about 10 to about 30 tufts.

4. The toothbrush of claim 1 wherein the ratio of stationary portion tufts to moveable portion tufts is about 3:1.

5. The toothbrush of claim 1 wherein the moveable portion tufts are of a different color than the stationary portion tufts.

* * * * *